United States Patent [19]

Volland et al.

[11] Patent Number: 4,651,785

[45] Date of Patent: Mar. 24, 1987

[54] COMPRESSED AIR SUPPLY DEVICE FOR A WEAVING MACHINE WITH PNEUMATIC PICKING OF AT LEAST TWO WEFT THREADS

[75] Inventors: Michel Volland, Bourgoin Jallieu; Roger Fourneaux, La Tour Du Pin; Gilles Grandvallet, Bourgoin Jallieu, all of France

[73] Assignee: Saurer-Diederichs S.A., Isere, France

[21] Appl. No.: 676,731

[22] Filed: Nov. 30, 1984

[30] Foreign Application Priority Data

Dec. 13, 1983 [FR] France ..... 83 20248

[51] Int. Cl.[4] ..... D03D 47/30

[52] U.S. Cl. ..... 139/435

[58] Field of Search ..... 139/435; 226/97

[56] References Cited

U.S. PATENT DOCUMENTS

| | | | |
|---|---|---|---|
| 4,143,681 | 3/1979 | Kuda et al. | 139/435 |
| 4,143,682 | 3/1979 | Jansa et al. | 139/435 |
| 4,410,016 | 10/1983 | Manders | 139/435 |
| 4,512,375 | 4/1985 | Deborde et al. | 139/435 |

FOREIGN PATENT DOCUMENTS

| | | | |
|---|---|---|---|
| 0090279 | 10/1983 | European Pat. Off. | 139/435 |
| 0114047 | 7/1984 | European Pat. Off. | 139/435 |

*Primary Examiner*—Henry S. Jaudon

*Attorney, Agent, or Firm*—Karl F. Ross; Herbert Dubno

[57] ABSTRACT

This pneumatic supply device is designed for shuttle-free weaving machines with the picking of one or more weft threads (1, 2) by elements such as picking nozzles (5, 6) and nozzle relays (10), supplied with compressed air in accordance with predetermined sequences. A robot (25) connected to a picking sequence program support (26) drives, on one hand, electrovalves (12, 16) disposed in the compressed air inlets (13, 17) to the picking elements (5, 6, 10) and, on the other hand, switching members (20, 21) enabling these picking elements (5, 6, 10) to be supplied at at least two different pressures (P1, P2; p1, p2) selected as a function of the characteristics of the weft threads (1, 2) to be inserted. The switching members (20, 21) are, for example, proportional pressure reducers enabling the control of the air pressure in a tank (18, 22).

6 Claims, 2 Drawing Figures

COMPRESSED AIR SUPPLY DEVICE FOR A WEAVING MACHINE WITH PNEUMATIC PICKING OF AT LEAST TWO WEFT THREADS

FIELD OF THE INVENTION

The present invention relates to a compressed air supply device designed for shuttle-less weaving machines with pneumatic weft picking. The invention relates more particularly to weaving machines which enable two or more weft threads having different characteristics to be picked in accordance with predetermined programs.

BACKGROUND OF THE INVENTION

In a weaving machine of this type, enabling, for example, the picking of two weft threads drawn respectively from two supply spools located on one side of the machine, the picking of the two weft threads is principally carried out by means of two picking nozzles supplied with compressed air and located on the side of the weaving machine. Each picking nozzle may be associated with a weft grip whose opening and closing action is itself controlled by pneumatic means.

The weft picking system also comprises, in general, other picking elements known as nozzle relays, or relay nozzles (i.e. auxiliary nozzles disposed along the picking axis), over the entire width of the weaving machine. These auxiliary nozzle relays which create air jets which complete the action of one or other of the picking nozzles in order to draw off and guide the weft threads until they reach the other side of the machine, are distributed in groups of N auxiliary nozzle, each group of auxiliary nozzle being supplied with compressed air via a pneumatic duct which is assigned thereto.

In accordance with the characteristics of the weft thread to be picked, it is necessary to adapt the picking parameters and, in particular, the compressed air pressures supplied to the various nozzles, as well as the operating times of these nozzles, so that the picking takes place, for each weft thread, under suitable conditions and without damaging the thread. Two or more compressed air pressures must therefore be available as well as two or more time sequences, and it must be possible to be able to select the pressure and sequence required for each weft thread as a function of the thread picking program carried out by the machine.

SUMMARY OF THE INVENTION

For this purpose, the present invention provides a supply device for a weaving machine with pneumatic picking of at least two weft threads by means of picking elements such as picking nozzles and auxiliary nozzles supplied with compressed air in accordance with predetermined programs, this device essentially comprising an electronic processor connected to a program support (i.e. a programmable unit which can be referred to as a memory) for the various weft thread picking sequences, distribution members disposed on the compressed air inlets to the picking elements and driven by the electronic processor to which they are connected by electrical time control connections, and switching members disposed in the pneumatic circuits upstream of the said distribution members and driven by the electronic processor to which they are connected by electrical pressure control connections, these switching members enabling the supply of the picking elements, from a single compressed air source of the weaving machine, at at least two different pressures selected as a function of the weft thread picking program.

The supply pressures of the picking nozzles and the nozzle relay groups are therefore automatically switched, in accordance with a predetermined program, in order to supply all these picking elements at a pressure which is suitable for the weft thread to be inserted. In addition, the electronic processor supplies, at the appropriate times, the signals controlling the opening and closing of the distribution elements such as electrovalves, which enable the supply of the picking elements at one or other of the possible pressures.

In accordance with a first embodiment of the invention, the compressed air supply device comprises at least two compressed air tanks disposed in parallel and filled at different pressures, the switching elements being flow-path selectors mounted between the tanks and the distribution elements and controlled by the electronic processor in accordance with the picking sequences in order to bring the weft picking elements into communication with one or other of the tanks. As one or more tanks filled with compressed air at suitably selected pressures are therefore provided, the nozzles are supplied from one or the other of these tanks by means of flow-path selectors disposed upstream of the electrovalves receiving the signals controlling the opening and closing times.

As the picking nozzles require, in general, a supply pressure which differs from that of the auxiliary nozzles, the device advantageously comprises in this case, at least two compressed air tanks for supplying the groups of auxiliary nozzles at at least two separate pressures, a flow-path selector driven by the electronic processor being associated with each group of auxiliary nozzles so as to bring it into communication with one or other of the tanks, and at least two further compressed air tanks for supplying the picking nozzles at at least two different pressures, a further flow-path selector driven by the the electronic processor being associated with the picking nozzles so as to bring them into communication with one or other of these further tanks. Bearing in mind the amount of compressed air required for the supply of the picking nozzles, the tanks associated therewith may be formed by compressed air conduits.

In accordance with a second embodiment of the invention, the compressed air supply device comprises at least one controlled pressure compressed air tank, the communication element being a proportional pressure reducer mounted between the compressed air source and the tank and driven by the electronic processor in accordance with the picking sequences in order to regulate the air pressure in this tank to at least two separate values suitable for the different weft threads to be picked. A single tank therefore enables two or more pressure values to be provided for the supply of the weft picking elements whose distribution members, such as electrovalves, may be directly connected to these tanks.

As the picking nozzles generally require a supply pressure which differs from that of the auxiliary nozzles, the device advantageously comprises in this case a compressed air tank for the supply of the auxiliary nozzles groups, this tank being connected to the compressed air source via a first proportional pressure reducer driven by the electronic processor, and at least one further compressed air tank for the supply of the picking nozzles, this other tank being connected to the compressed air source via a second proportional pressure reducer driven by the electronic processor. Bearing in mind the amount of compressed air required for supplying the picking nozzles, the tank associated therewith may be formed by a compressed air conduit.

In both of the embodiments described above, if weft grips with pneumatic control are associated with the picking nozzles there is provided a compressed air supply conduit which supplies these weft grips at a predetermined pressure, with a specific distribution member also driven by the electronic processor to which it is connected by an electrical time control connection, as well as a double inverter disposed downstream of the distribution members of the picking nozzles and the weft grips and driven by the electronic processor, so as to control, in a selective manner, the picking nozzle and the weft grip corresponding to the threads to be picked.

BRIEF DESCRIPTION OF THE DRAWING

The invention is now described in detail with reference to the attached drawings which show two embodiments of this compressed air supply device used with a weaving machine operating by pneumatic picking of two weft threads, and in which.

SPECIFIC DESCRIPTION

In these two drawings, single continuous lines indicate the pneumatic connections, dashed lines indicate the electrical time control connections, dot-dash lines indicate the electrical pressure control connections and double continuous lines indicate the selection connection for the "picking nozzle and associated weft grip" assembly.

Figure 1:
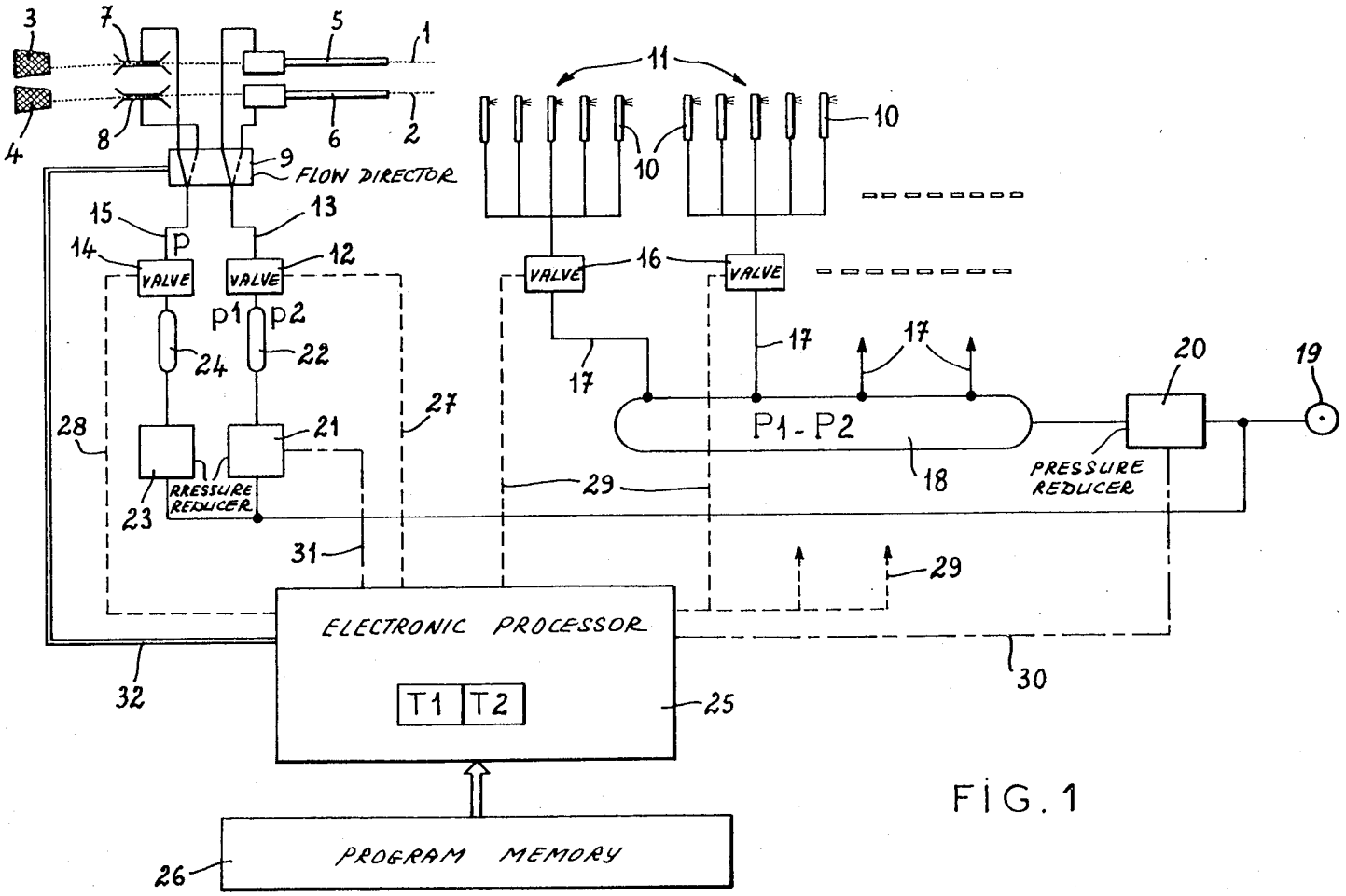
FIG. 1 is a diagram of a supply device of the invention with compressed air tanks associated with proportional pressure reducers enabling the provision of different pressures.
Figure 2:
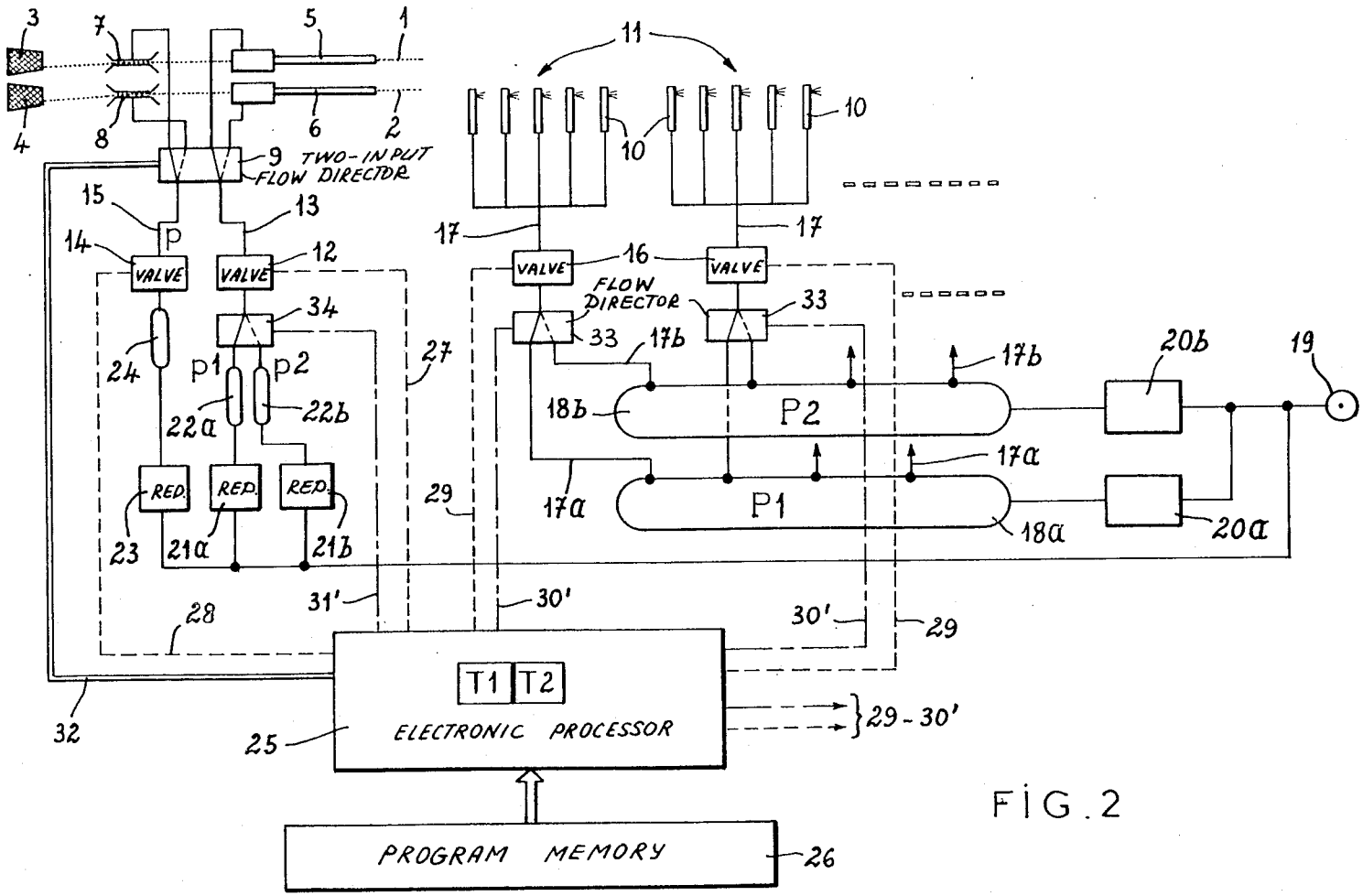
FIG. 2 is a diagram of a supply device of the invention with compressed air tanks at different pressures.

The diagram of FIGS. 1 and 2 show compressed air supply devices for a weaving machine enabling the picking of two weft threads 1, 2 drawn from respective supply spools 3, 4.

The weaving machine has on one side two picking nozzles 5, 6, each of which is designed pneumatically to pick one of the weft threads 1, 2. Each picking nozzle 5, 6 is associated with a pneumatically controlled weft grip 7, 8 respectively disposed upstream of the corresponding nozzle. A two input electrically operated flow director 9 enables the selective control of either the first picking nozzle 5 and the first weft grip 7, or the second picking nozzle 6 and the second weft grip 8, in accordance with the weft thread 1 or 2 to be picked.

Downstream of the picking nozzles 5, 6 there are disposed a number of auxiliary nozzles 10 located over the entire width of the weaving machine and divided into successive groups 11 each having N nozzles. The same auxiliary nozzles 10 operate during the picking of either of the two weft threads 1, 2.

In each of the cases shown here, there is provided an electrovalve (picking-nozzle valve) 12 disposed in the compressed air conduit 13 to the picking nozzles 5, 6, an electrovalve (picking-nozzle valve) 14 disposed in the compressed air inlet 15 to the weft grips 7, 8 and a sequence of electrovalves (auxiliary-nozzle valves) 16 disposed in the compressed air conduits 17 to the various auxiliary nozzle groups 11.

In the particular embodiment of FIG. 1, there is provided a single main compressed air tank 18 connected to a compressed air source 19 of the weaving machine by means of a first proportional pressure reducer 20. The various compressed air conduits 17 which reach the groups 11 of auxiliary nozzles 10 are connected directly to the tank 18.

The compressed air source 19 is also connected, via a second proportional pressure reducer 21, to an auxiliary tank 22 from which there leads the compressed air conduit 13 supplying the picking nozzles 5, 6, as well as to an auxiliary tank 24, via a simple pressure reducer 23, from which there leads the compressed air conduit 15 supplying the the weft grips 7, 8. The auxiliary tanks 22, 24 may be formed by the conduits themselves.

The control of all the compressed air supply members listed above is carried out by electronic processor 25 in accordance with a sequence "T1" or "T2" itself selected by the program of the weft threads to be picked, the memory of the thread sequence program being shown very schematically at 26. Electrical time control connections 27, 28, 29 connect the electronic processor 25 respectively to the electrovalve (picking nozzle valve) 12 disposed in the compressed air inlet (13) to the picking nozzles 5, 6, to the electrovalve (picking nozzle valve) 14 disposed in the compressed air inlet 15 for the weft grips 7, 8, and to the electrovalves (auxillary nozzle valve) 16 disposed in the compressed air conduits 17 for the various groups 11 of auxiliary nozzles 10. Two electrical pressure control connections 30, 31 also connect the electronic processor 25 respectively to the first proportional pressure reducer 20 disposed upstream of the main tank 18 and to the second proportional pressure reducer 21 disposed upstream of the auxiliary tank 22. Finally, a connection 32 connects the electronic processor 25 to the two-input flow director 9 for controlling the supply of one or other of the "picking nozzle and associated weft grip" assemblies 5, 7 or 6, 8.

During operation of the weaving machine, the pressure in the single main tank 18 is controlled, via the first proportional pressure reducer 20 itself driven by the electronic processor 25. In a "T1" sequence, corresponding to the picking of the first weft thread 1, the pressure reducer 20 regulates the air pressure in the tank 18 to a specific value "P1" designed for the supply of the auxiliary nozzles 10 for the picking of this first weft thread 1. In a "T2" sequence, corresponding to the picking of the second weft thread 2, the pressure reducer 20 regulates the air pressure in the same tank 18 to a further value "P2" designed for the supply of the auxiliary nozzles 10 for the picking of this second weft thread 2. For each group 11 of auxiliary nozzle 10, supplied by a conduit 17 at one or other of the pressures "P1" and "P2", the electrovalve (auxiliary nozzle valve) 16 is opened and closed at precise instants as a function of signals transmitted from the electronic processor 25 by the electrical connections 29.

In a similar manner, the pressure in the auxiliary tank 22 is controlled by means of a second proportional pressure reducer 21. It is therefore regulated to a specific value "p1" for supplying the picking nozzle 5, and to a further value "p2" for supplying the picking nozzle 6 via the conduit 13.

The additional pressure reducer 23 sets an invariable pressure value "p" in the auxiliary tank 24 and the conduit 15 which supplies the weft grips 7, 8.

The electrovalves (picking nozzle valves) 12, 14 are opened and closed at precise instants as a function of signals transmitted from the electronic processor 25 via the electrical connections 27, 28. The two-input flow director 9 disposed downstream of these electrovalves (picking nozzle valves) 12, 14, and itself driven by the electronic processor 25 in accordance with the program for the threads to be picked, is designed to supply either the nozzle 5 or the nozzle 6 when the electrovalve 12 is open, and to supply selectively either the weft grip 7 or the weft grip 8 when the electrovalve 14 is open.

In the particular embodiment of FIG. 2, in which corresponding elements are indicated by the same reference numerals, the compressed air source 19 of the weaving machine is connected to a first main tank 18*a* by means of a simple pressure reducer 20*a* and to a second main tank 18*b* by means of a further simple pressure reducer 20*b*. The first tank 18*a* is therefore filled with air at a specific pressure "P1" designed for supplying the auxiliary nozzles 10 for the picking of the first weft thread 1, while the second tank 18*b* disposed in parallel with the first is filled with air at a further pressure "P2" designed for supplying the auxiliary 10 for the picking of the second weft thread 2.

For each group 11 of auxiliary nozzles 10 there is provided a supply conduit 17*a* leading from the first tank 18*a* and a further supply conduit 17*b* leading from the second tank 18*b*. The two corresponding conduits 17*a*, 17*b* lead to a single output/two input flow director 33 disposed upstream of the electrovalve 16 in the common air inlet 17 to the group 11 in question. All of the flow directors 33 are connected to the electronic processor 25 by means of electrical connections 30' enabling them to be controlled in accordance with the sequence "T1" or "T2" for the supply of the nozzle relays 10, either at the pressure "P1" from the first tank 18*a* or at the pressure "P2" from the second tank 18*b* in accordance with the program for the threads to be picked. The electrovalves 16 operate as described above.

In a similar manner, two simple pressure reducers 21*a*, 21*b* enable the respective supply of the two auxiliary tanks 22*a*, 22*b* disposed in parallel from the compressed air source 19 at pressures having the different values "p1" and "p2". A flow director 34, disposed upstream of the electrovalve 12 enables the supply conduit 13 of the picking nozzles 5, 6 to be brought into communication either with the tank 22*a* or with the tank 22*b*. The flow director 34 is connected to the electronic processor 25 by a connection 31' enabling its control in accordance with the sequence "T1" or "T2" for the supply of either the picking nozzle 5 at the pressure "p1" from the the tank 22*a* or the picking nozzle 6 at the pressure "p2" from the tank 22*b*.

A further auxiliary tank 24 supplies the weft grips 7, 8 at an invariable pressure "p" in the same way as before.

The auxiliary tanks 22*a*, 22*b*, 24 may, in this case, also be formed by the conduits themselves.

The two-input, four-output flow director 9 operates as before so as to enable the supply of compressed air either to the picking nozzle 5 and the associated weft grip 7, or to the other picking nozzle 6 and the associated weft grip 8.

It is evident that the invention is not limited to the two embodiments of this compressed air supply device for a weaving machine which are described above by way of example. The invention covers, in contrast, all structural and operational variants based on the same concept. It would not therefore lie outside of the scope of the invention to replace the distribution and switching members mentioned by any equivalent means. Moreover, the applications of the invention are not limited to a weaving machine enabling the picking of two weft threads, as it may be used in general with a machine for the picking of any number of wefts, with a corresponding increase in the number of certain elements and the operating sequences programmed.

We claim:

1. In a shuttleless weaving machine comprising a plurality of picking nozzles at a side of the machine and directed across a width of the machine for picking respective weft threads in a weft insertion, and a plurality of groups of auxiliary nozzles common to all weft insertions spaced across the width of the machine for carrying each weft thread thereacross, the combination therewith of a compressed-air supply device which comprises:

a compressed-air source;

a plurality of compressed-air reservoirs connected to said source;

a respective pressure reducing valve connected between said source and each of said reservoirs for controlling the pressure in said reservoir;

respective electrically operated auxiliary-nozzle valves between each group of auxiliary nozzles and at least one of said reservoirs;

a respective electrically operated picking-nozzle valve connected between at least one of said reservoirs and said picking nozzles;

at least one electrically operated flow director connected with both of said picking nozzles for selectively applying air under pressure from at least one of said reservoirs to either of said picking nozzles through said picking-nozzle valve so that either of two pressures can be applied selectively to either of said picking nozzles;

an electronic processor connected to said valves and to said flow directors for operating said groups of auxiliary nozzles and said picking nozzles with respective different air pressures in accordance with characteristics of the threads for respective picks in respective preprogrammed timing sequences for the respective picks; and a memory for said sequences connected to said electronic processor for generating respective timing programs for applying each of two different pressures to the groups of auxiliary nozzles and each of two different pressures to said picking nozzles in said respective preprogrammed timing sequences.

2. The combination defined in claim 1 wherein said reservoirs comprise at least two compressed-air tanks disposed in parallel and filled at different pressures through said pressure-reducing valves, said flow directors including a flow director between two of said tanks and a respective one of said auxiliary-nozzle valves, and a further flow director between two of said tanks and said picking-nozzle valve.

3. The combination defined in claim 2 wherein the two tanks supplying said picking-nozzle valve are different from the tanks supplying said auxiliary-nozzle valve.

4. The combination defined in claim 2 wherein the two tanks supplying said picking-nozzle valve are compressed air ducts.

5. The combination defined in claim 1, further comprising a pneumatically controlled weft grip associated with each of said picking nozzles, a conduit for supplying said weft grips with a predetermined pressure, said weft grips being supplied through a further electrically operated valve controlled by said electronic processor.

6. The combination defined in claim 5 wherein a two-input, four-output flow distributor is provided to connect both of said weft grips to said further valve and both of said picking nozzles to said picking-nozzle valve.

* * * * *